US009708766B2

(12) United States Patent
McPherson

(10) Patent No.: US 9,708,766 B2
(45) Date of Patent: Jul. 18, 2017

(54) COVER DEVICE FOR A DRAINAGE APPARATUS FOR A PAPERMAKING MACHINE

(71) Applicant: Paperchine Inc., Rockton, IL (US)

(72) Inventor: Douglas McPherson, Springfield, MA (US)

(73) Assignee: Paperchine Inc., Rockton, IL (US)

( * ) Notice: Subject to any disclaimer, the term of this patent is extended or adjusted under 35 U.S.C. 154(b) by 0 days.

(21) Appl. No.: 13/261,926

(22) PCT Filed: Jan. 30, 2013

(86) PCT No.: PCT/US2013/023935

§ 371 (c)(1),
(2) Date: Jul. 2, 2014

(87) PCT Pub. No.: WO2013/116397

PCT Pub. Date: Aug. 8, 2013

(65) Prior Publication Data

US 2014/0345820 A1 Nov. 27, 2014

Related U.S. Application Data

(63) Continuation of application No. 13/754,704, filed on Jan. 30, 2013, now abandoned.

(60) Provisional application No. 61/632,782, filed on Jan. 30, 2012.

(51) Int. Cl.
*D21F 1/80* (2006.01)
*D21F 1/52* (2006.01)

(52) U.S. Cl.
CPC ..... *D21F 1/523* (2013.01)

(58) Field of Classification Search
CPC ..... D21F 1/80; D21F 1/66
USPC ..... 162/308
See application file for complete search history.

(56) References Cited

U.S. PATENT DOCUMENTS

| | | | |
|---|---|---|---|
| 3,556,939 | A | 1/1971 | Stenberg |
| 6,158,144 | A | 12/2000 | Weber et al. |
| 6,395,136 | B1 | 5/2002 | Anderson et al. |

FOREIGN PATENT DOCUMENTS

| | | |
|---|---|---|
| WO | 9605370 | 2/1996 |
| WO | WO2007/042623 A1 | 4/2007 |

*Primary Examiner* — Mark Halpern
(74) *Attorney, Agent, or Firm* — Volpe and Koenig, P.C.

(57) ABSTRACT

A cover device (10) is disclosed for use in a dewatering shoe or other drainage device of a papermaking machine. The cover device (10) includes a plate (12) of expanded metal which defines a plurality of elongate holes (14, 15, 16, 17, 18, 19, 20 and 21) for the passage therethrough of water as indicated by the arrow (22) removed from a web W disposed on a dewatering screen (24) moving in a machine direction MD relative to the cover device (10). The arrangement is such that the dewatering screen (24) is disposed between the web W and the cover device (10) so that the water (22) is removed from the web W through the dewatering screen (24) and then through the elongate holes (14 to 21).

12 Claims, 7 Drawing Sheets

COVER DEVICE FOR A DRAINAGE APPARATUS FOR A PAPERMAKING MACHINE

This application is a 371 of PCT/US13/23935 filed 30 Jan. 2013.

BACKGROUND OF THE INVENTION

Field of the Invention

The present invention relates to a cover device for a dewatering shoe of a papermaking machine.

More specifically, the present invention relates to a cover device for a dewatering shoe of a papermaking machine in which the cover permits a flow therethrough of water removed from a web.

Background Information

The invention concerns a fluid previous cover device for a drainage shoe or a drainage box, curved vacuum box and the like or a similar drainage device in a papermaking machine. The cover device may also be suitable for use with a suction or gravity drainage box in the forming section, a Uhle box in the press section, or other drainage device used to assist with water removal from a web being conveyed through the machine.

In the manufacture of paper and similar cellulosic products, an aqueous stock consisting of about 97-99% water and 3% to about 1% papermaking solids is ejected at high speed onto a forming fabric in the forming section of a papermaking machine. The forming section is required to drain a large percentage of this water through the forming fabric so that, by the end of the forming section, a nascent web consisting of about 20% to 25% papermaking solids is transferred to a press section where a further proportion of water is removed by mechanical pressure. The resulting web then passes to the dryer section of the machine where the remaining water is removed by evaporative means so that, by the end of the dryer section, the final paper product consists of about 97% to 99% papermaking solids with the remainder as water. Various known drainage devices are used in the forming and press sections of the papermaking machine, such as the initial forming shoe, other drainage shoes (which may or may not be vacuum assisted) and devices such as Uhle boxes in the press section; these devices are required to manage and remove these large volumes of water effectively and efficiently. Such devices, and their covers which arc shaped and located so as to provide contact with the forming or press fabrics and to assist the management of the water drained from the sheet, have been previously described. See for example, Irwin et al. U.S. Pat. No. 4,734,164; Fujiwara U.S. Pat. No. 4,425,188; Wildfong et al. U.S. Pat. No. 6,372,091; Buchanan et al U.S. Pat. No. 7,005,040, and others which disclose various means of water management including grooves, flow through venting. A problem common to all of these prior art solutions is the high cost of manufacturing these drainage box covers, which are typically formed from a ceramic or other wear-resistant surface material that is arranged so as to be in intimate contact with the forming fabrics upon which the embryonic web is located. This surface must be vented, drilled or otherwise machined to provide the necessary flow-through drainage into the drainage device located in supporting contact with the cover. A long felt need has existed in the papermaking art for a cover for a drainage device for use in a papermaking process in which the cover could be quickly and easily manufactured to provide a selectable open area at a much lower cost than has previously been possible. Additionally, there has been a need for the cover device to be flexible in at least one of the machine direction and cross-machine direction to permit production of a cover having a variable curvature. Also, there has been a long felt need for a cover that would be resistant to abrasive wear caused by prolonged sliding contact between the papermaking fabrics and cover surface. The present invention addresses these long felt needs.

The drainage surface of the cover of the present invention has a selectable open area and is comprised of an expanded metal material, in particular a tubular slit expanded metal. The expanded metal is preferably of stainless steel which has been coated with a suitable wear resistant material such as a ceramic or other wear resistant coating.

Expanded metal is a well known and versatile construction material and has been disclosed in for example EP 797,486 to Kloeckner, U.S. Pat. No. 6,691,386 to Marlow and U.S. Pat. No. 7,934,301 to Mulder.

One example of a suitable expanded metal for use in the present invention is of the type referred to as "tubular slit" and is commercially available from Ferguson Perforating Inc. of Providence, R.I. This material is formed from a planar metal sheet which has been regularly and discontinuously slit and then expanded in the Z-direction between each slit to provide a regular grid of generally rectangular openings between which are located planar surfaces which have been deformed above and below the plane of the sheet to form first and second surfaces. The expanded areas form regular, parallel, generally rhombic shaped tubular openings separated by and interconnected by land areas oriented in a first direction across the plane of the sheet. The opposing surfaces of the openings are alternately and equidistantly expanded in a second direction (the Z-direction) so as to be raised above and below the plane of the land areas to provide generally planar opposing surfaces. The opposing surfaces are oriented in a third direction along the plane of the sheet which direction is perpendicular to the first and second directions. The opposing surfaces define the tubular openings and land areas oriented in the first direction.

In the present invention sections of tubular slit expanded metal such as described above are welded or otherwise bonded together in a size suitable to form the surface or cover device of a drainage shoe, suction or other drainage box over which a papermaking or other industrial filtration fabric or dewatering screen and product thereon will pass in sliding contact as they move continuously from an upstream to a downstream edge of the cover device in a machine direction.

When in use, the expanded metal sheet is oriented on the drainage device so that the series of tubular openings and land areas extending in the first direction are oriented at an angle of about 45° to the machine direction. During operation, fluid is skimmed from the underside of the filtration fabric by the first surface which is the fabric contact surface of the expanded metal as the fabric passes between the generally rectangular openings and land areas of the first surface. The fluid then passes through the tubular openings and out through the corresponding openings of the second surface. The open area of the drainage surface is selectable by appropriate selection of the size of the rectangular openings and land areas in at least the first surface of the expanded metal sheet.

The novel drainage surfaces of the present invention offer the advantages of ease of manufacture and a reduction in cost to the consumer.

The novel cover device according to the present invention provides many benefits regarding the manufacture of the cover device and the operation thereof on a paper machine.

Numerous advantages are obtained by forming the cover device of a drainage apparatus from expanded metal. These advantages include:

1/ Expanded metal provides increased stiffness compared with a prior art single sheet drilled or perforated plate.

2/ Expanded metal can create bending flexibility in one direction and stiffness in another direction which was not previously possible; this permits variation in cover device design and the ability to simplify manufacture of a variable curvature cover.

3/ The welded structure of the cover device incorporating expanded metal according to the present invention is easier to manufacture thus reducing the manufacturing complexity of the cover device and delivery time.

4/ The expanded metal structure of the cover device, with the ability to be recoated multiple times, provides a much longer life potential than ceramic drainage device covers which can only be reground typically, once if at all.

5/ The relatively thinner ceramic coated metal material in contact with the fabric allows water to be removed more easily than for example with the prior art covers in which the water removed from the fabric has to pass along surface grooves along or through long drilled holes.

6/ The relatively more open structure of the cover device of the present invention is less prone to plugging problems than previous prior art arrangements.

7/ The present invention provides a novel cover device and the ability to easily shape the fabric contacting surface profile thereof which offers unique opportunities to affect drainage rates and a flow through the cover and thus adapt it to different applications on the machine.

7/ The open area of the cover can also be varied independent of, or as part of the profile of the surfaces, by changing the size of the upper and lower surface contact points.

8/ For certain applications, the open area can be significantly increased while maintaining a high support index for the fabric. This can be particularly important where a prior art slotted cover tends to damage fabrics or where deflection due to high vacuum induces unwanted forces into the stock structure supported on the fabric.

9/ The flexibility of the material in one direction and not the other allows the cover to support itself in the cross machine direction but also to be flexible in the machine direction. This offers the opportunity to build a cover that can be changed in shape during operation to allow drainage rates and pressure pulses to be altered to achieve optimal benefits. This is particularly important in the impingement or initial forming section area of the paper making machine.

Therefore, it is a primary feature of the present invention to provide a cover device for a dewatering shoe of a papermaking machine that overcomes the problems associated with the prior art arrangements.

Another feature of the present invention is the provision of a cover device for a dewatering shoe or the like that greatly reduces the cost of manufacture thereof.

Another feature of the present invention is the provision of a cover device for a dewatering shoe that provides better drainage and flexibility compared with prior arrangements.

Other features and advantages of the present invention will be readily apparent to those skilled in the art by a consideration of the detailed description of a preferred embodiment of the present invention contained herein.

SUMMARY OF THE INVENTION

A cover device for a dewatering shoe of a papermaking machine is disclosed. The cover device includes a plate of expanded metal which defines a plurality of elongate holes for the passage therethrough of water removed from a web disposed on a dewatering screen moving relative to the cover device. The arrangement is such that the dewatering screen is disposed between the web and the cover device so that the water is removed from the web through the dewatering screen and then through the elongate holes. A first row of holes of the plurality of elongate holes is arranged such that each hole of the first row has a first common longitudinal axis. A second row of holes of the plurality of elongate holes is arranged such that each hole of the second row has a second common longitudinal axis. Also, the first and second common longitudinal axes are disposed spaced and parallel relative to each other.

In a more specific embodiment of the present invention, the plate has a leading edge and a trailing edge. The leading edge and the trailing edge are disposed parallel and spaced relative to each other. Also, the leading edge and the trailing edge are disposed parallel relative to a cross machine direction of the dewatering screen when moving relative to the cover device.

Additionally, the common longitudinal axes of the rows of holes are disposed parallel relative to the cross machine direction.

In an alternative embodiment of the present invention, the common longitudinal axes of the rows of holes are disposed normal relative to the cross machine direction.

In a preferred embodiment of the present invention, the common longitudinal axes of the rows of holes are disposed at an angle within a range of from 35 to 55 degrees relative to the cross machine direction.

Moreover, a metal bridge is disposed between each hole of the first row of holes and an adjacent hole of the first row of holes.

Furthermore, a metal connector is disposed between each hole of the first row and an adjacent hole of the second row.

In a preferred embodiment of the present invention, a first column of bridges is disposed parallel and spaced relative to a second column of bridges. Also, a column of connectors is disposed parallel and spaced relative to the first and second column of bridges. The column of connectors is disposed between the first column of bridges and the second column of bridges.

More specifically, each bridge is disposed at a first distance relative to the dewatering screen which moves in a machine direction relative to the cover device. Also, each adjacent connector is disposed at a second distance relative to the dewatering screen moving in the machine direction relative to the cover device. The second distance is greater than the first distance so that the dewatering screen slides over and is supported by the bridges during movement of the dewatering screen while moving relative to the cover device.

Preferably, the plate is fabricated from stainless steel.

Additionally, the plate is coated with ceramic material.

Many modifications and variations of the present invention will be readily apparent to those skilled in the art by a consideration of the detailed description contained hereinafter taken in conjunction with the annexed drawings which show a preferred embodiment of the present invention.

However, such modifications and variations fall within the spirit and scope of the present invention as defined by the appended claims.

BRIEF DESCRIPTION OF THE DRAWINGS

Similar reference characters refer to similar parts throughout the various views and embodiments of the drawings.

DETAILED DESCRIPTION OF THE DRAWINGS

Figure 1:
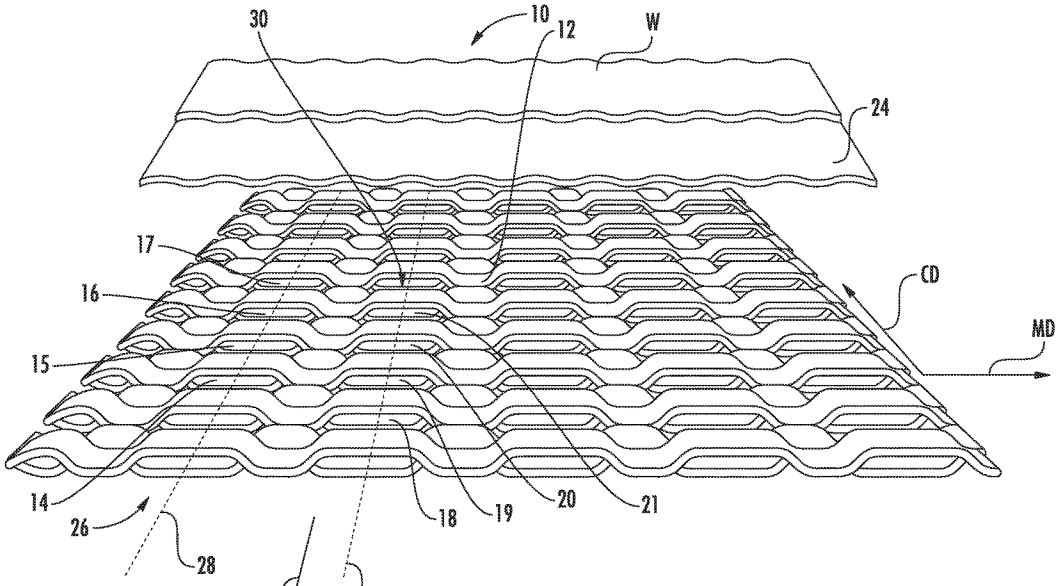
FIG. 1 is a perspective view of a cover device according to the present invention for a dewatering shoe of a papermaking machine.

FIG. 1 is a perspective view of a cover device generally designated 10 for use in a dewatering shoe or other drainage device of a papermaking machine. As shown in FIG. 1, the cover device 10 includes a plate 12 of expanded metal which defines a plurality of elongate holes 14, 15, 16, 17, 18, 19, 20 and 21 for the passage therethrough of water as indicated by the arrow 22 removed from a web W disposed on a dewatering screen 24 moving in a machine direction as indicated by the arrow MD relative to the cover device 10. The arrangement is such that the dewatering screen 24 is disposed between the web W and the cover device 10 so that the water 22 is removed from the web W through the dewatering screen 24 and then through the elongate holes 14 to 21. A first row generally designated 26 of holes 14 to 17 of the plurality of elongate holes 14 to 21 is arranged such that each hole such as hole 14 of the first row 26 has a first common longitudinal axis 28. A second row generally designated 30 of holes 18 to 21 of the plurality of elongate holes 14 to 21 is arranged such that each hole such as hole 18 of the second row 30 has a second common longitudinal axis 32. Also, the first and second common longitudinal axes 28 and 32 are disposed spaced and parallel relative to each other.

Figure 2:
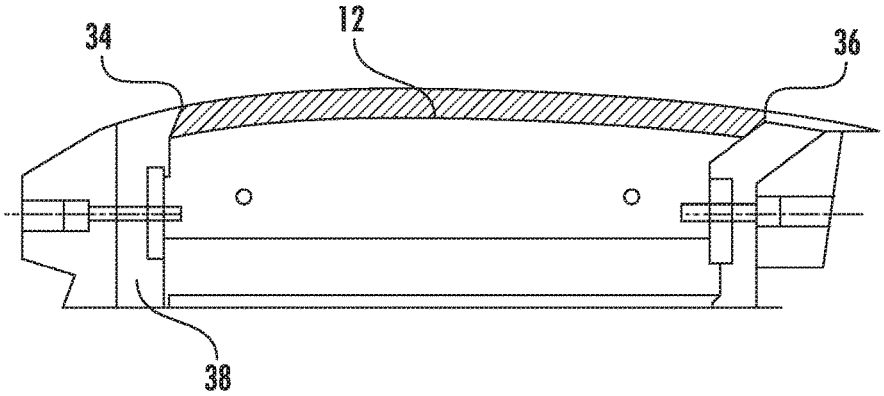
FIG. 2 is a side elevational view of the cover device shown in FIG. 1.

FIG. 2 is a side elevational view of the cover device 10. As shown in FIG. 2, the plate 12 has a leading edge 34 and a trailing edge 36. The leading edge 34 and the trailing edge 36 are disposed parallel and spaced relative to each other. Also, the leading edge 34 and the trailing edge 36 are disposed parallel relative to a cross machine direction as indicated by the arrow CD shown in FIG. 1 of the dewatering screen 24 when moving as indicated by the arrow MD relative to the cover device 10.

Additionally, the common longitudinal axes 28 and 32 of the rows of holes 14 to 17 and 18 to 21 respectively are disposed parallel relative to the cross machine direction CD as shown in FIG. 1.

Figure 3:
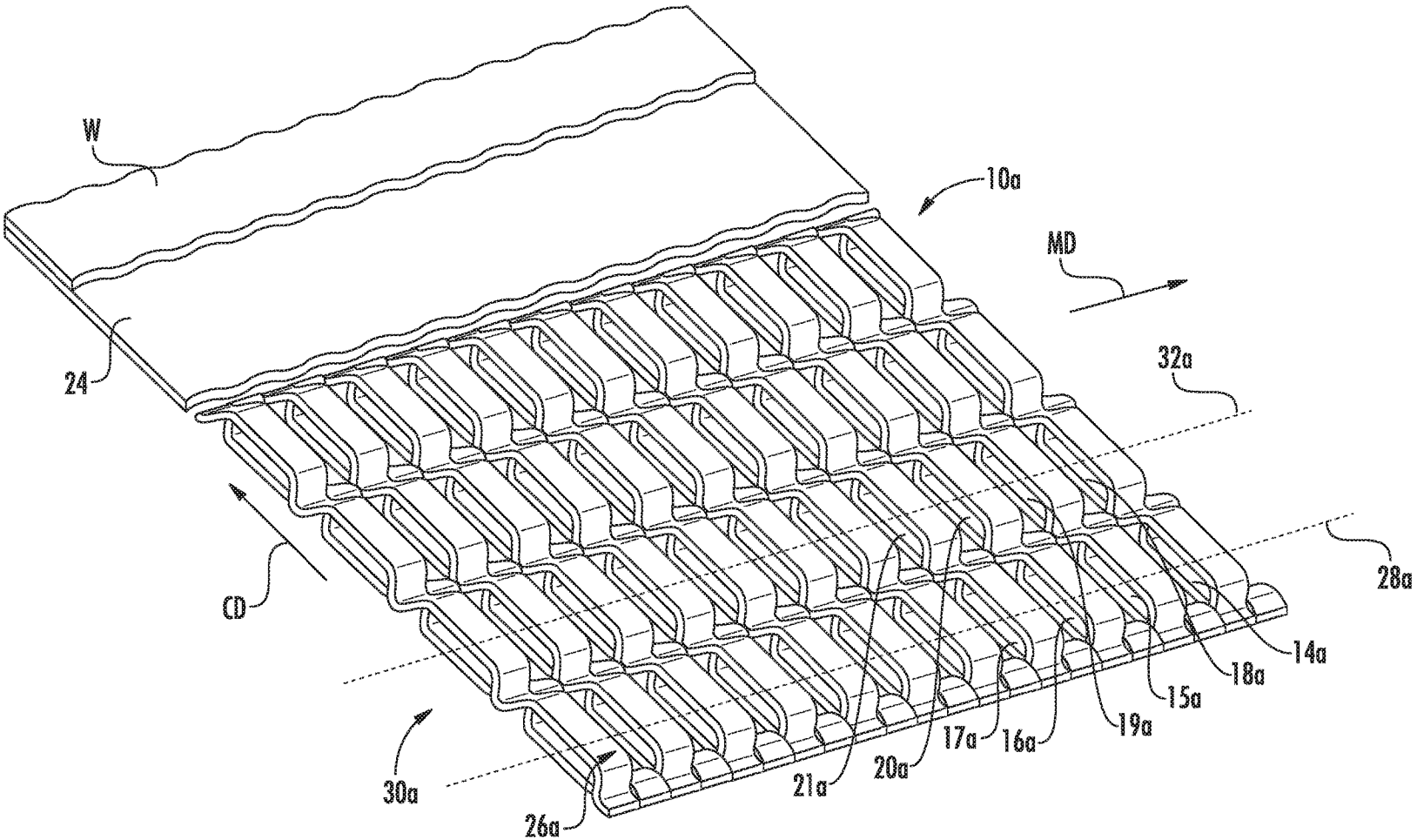
FIG. 3 is a perspective view of a cover device according to an alternative embodiment of the present invention.

FIG. 3 is a perspective view of a cover device generally designated 10*a* according to an alternative embodiment of the present invention. As shown in FIG. 3, the common longitudinal axes 28*a* and 32*a* of the first and second rows 26*a* and 30*a* respectively of holes 14*a* to 17*a* and 18*a* to 21*a* respectively are disposed normal that is 90 degrees relative to the cross machine direction CD.

Figure 4:
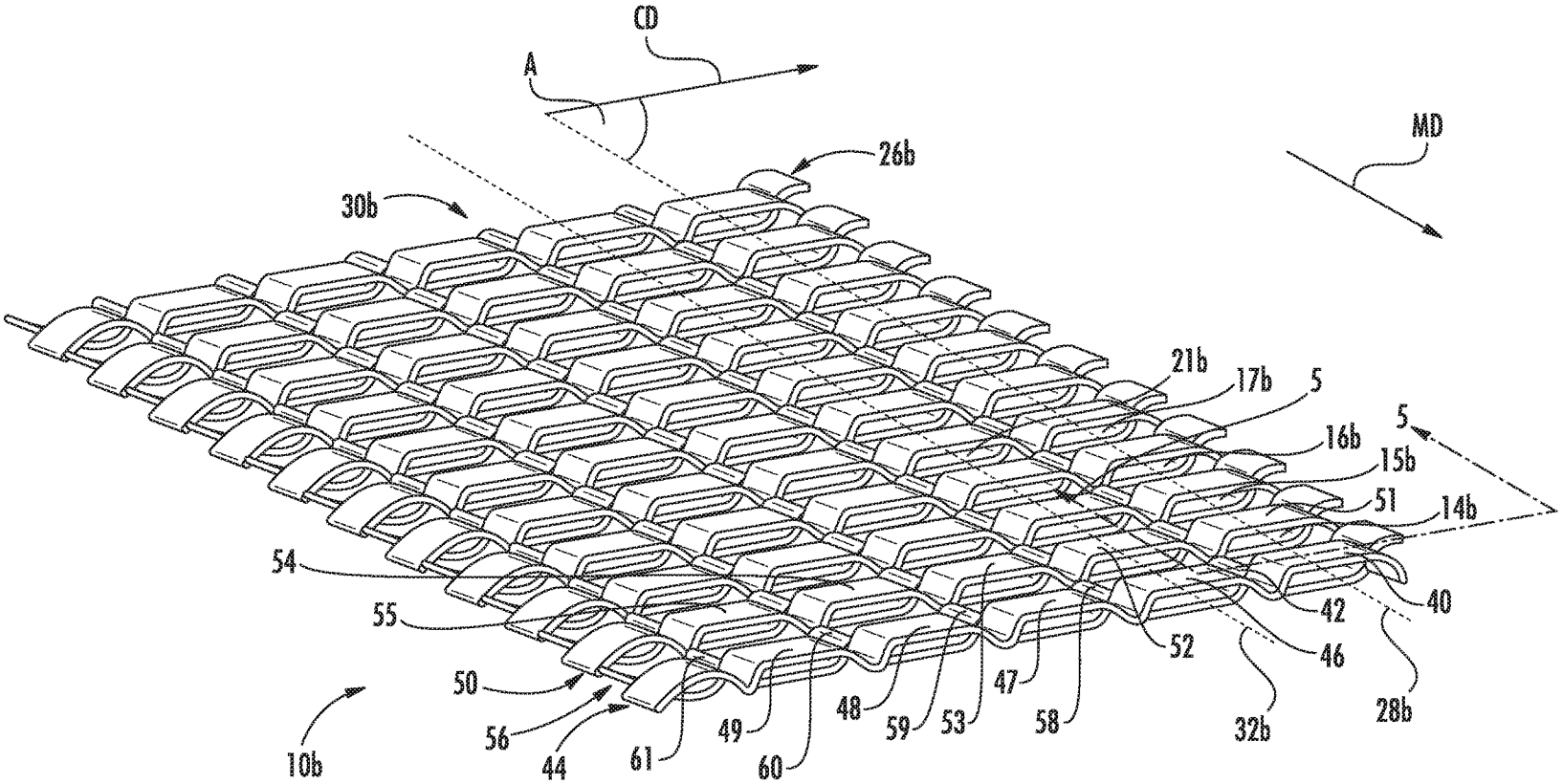
FIG. 4 is a perspective view of a cover device according to another embodiment of the present invention.

FIG. 4 is a perspective view of a cover device generally designated 10*b* according to another embodiment of the present invention. As shown in FIG. 4, the common longitudinal axes 28*b* and 32*b* of the first and second rows 26*b* and 30*b* respectively of holes 14*b* to 17*b* and 18*b* to 21*b* respectively are disposed at an angle A which is within a range 35 to 55 degrees and more specifically, 45 degrees relative to the cross machine direction CD. In FIG. 4, the dewatering screen 24 and web W have been removed for clarity.

Those skilled in the art will appreciate that the plate 12*b* may be formed by welding or otherwise joining together in abutting relationship several sheets of the expanded metal and then cutting the same to provide a leading and trailing edge 34 and 36 respectively as shown in FIG. 2. The plate 12 shown in FIG. 2 can also be bent to conform to the contour of the dewatering shoe 38 shown in FIG. 2. Additionally, although in the preferred embodiment of the present invention, the axes 28*b* and 32*b* are shown within a range of 35 to 55 degrees and preferably 45 degrees relative to the CD, any angle of the axes 28*b* and 32*b* relative to the cross machine direction CD could be used within the concept of the present invention.

Moreover, as shown in FIG. 4, a metal bridge 40 is disposed between each hole such as 14*b* of the first row 26*b* of holes 14*b* to 17*b* and an adjacent hole such as 15*b* of the first row 26*b* of holes 14*b* to 17*b*.

Furthermore, a metal connector 42 is disposed between each hole such as 15*b* of the first row 26*b* and an adjacent hole such as 19*b* of the second row 30*b* of holes 18*b* to 21*b*.

According to the present invention, a first column generally designated 44 of bridges 40, 46, 47, 48 and 49 is disposed parallel and spaced relative to a second column generally designated 50 of bridges 51, 52, 53, 54 and 55. Also, a column generally designated 56 of connectors 42, 58, 59, 60 and 61 is disposed parallel and spaced relative to the first column 44 of bridges 40*b*, 46*b* to 49*b* and the second column 50 of bridges 51 to 55. The column 56 of connectors 42 and 58 to 61 is disposed between the first column 44 of bridges and the second column 50 of bridges.

Figure 5:
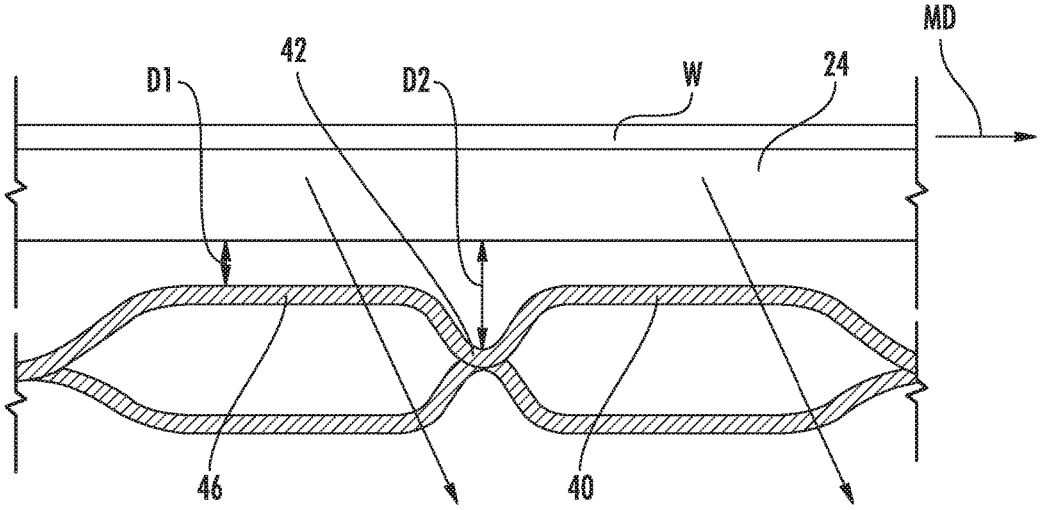
FIG. 5 is an enlarged sectional view taken on the line 5-5 of FIG. 4.

FIG. 5 is an enlarged sectional view taken on the line 5-5 of FIG. 4. As shown in FIG. 5, each bridge 40, 46 is disposed at a first distance D1 relative to the dewatering screen 24 moving relative to the cover device 10*b*. Also, each adjacent connector 42, 58 is disposed at a second distance D2 relative to the dewatering screen 24 moving relative to the cover device 10*b*. The second distance D2 is greater than the first distance D1 so that the dewatering screen 24 slides over and is supported by the bridges 40, 46 during movement of the dewatering screen 24 while moving relative to the cover device 10*b*.

Preferably, the plate 12*b* is fabricated from stainless steel.

Additionally, the plate 12*b* is coated with ceramic material.

Figure 6:
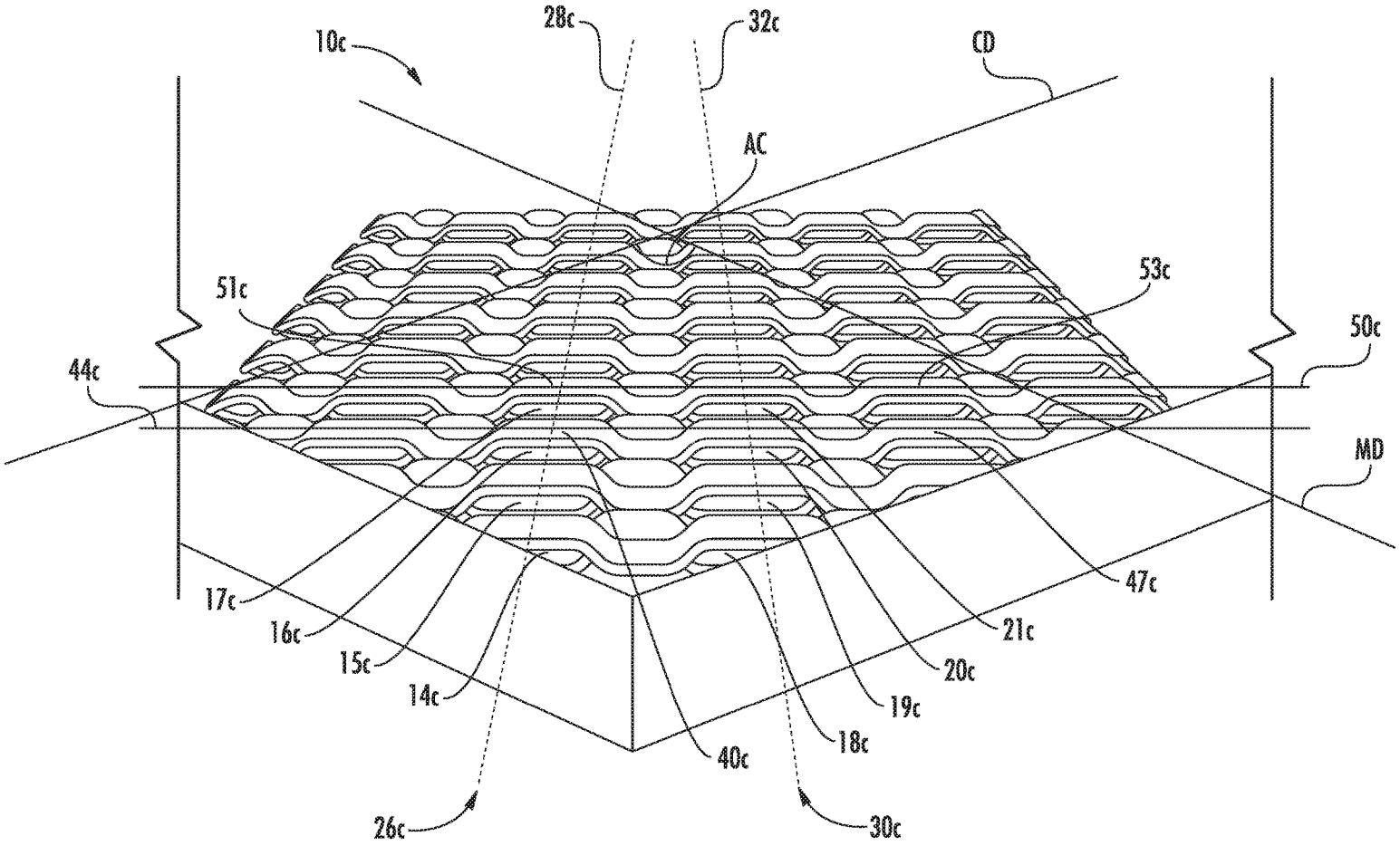
FIG. 6 is a perspective view of a cover device according to a preferred embodiment of the present invention.

FIG. 6 is a perspective view of a cover device generally designated 10*c* according to a preferred embodiment of the present invention. As shown in FIG. 6, the common longitudinal axes 28*c* and 32*c* of the first and second rows 26*c* and 30*c* respectively of holes 14*c* to 17*c* and 18*c* to 21*c* respectively are disposed at an angle Ac which is within a range from 35 to 95 degrees relative to the cross machine direction CD. In FIG. 6, the dewatering screen 24 and web W have been removed for clarity.

According to the preferred embodiment of the present invention as shown in FIG. 6, a first column generally designated 44*c* of bridges 40*c* and 47*c*, is disposed parallel and spaced relative to a second column generally designated 50*c* of bridges 51*c* and 53*c*. As shown in FIG. 6, each column such as column 44*c* is staggered or offset relative to an adjacent column 50*c*. The staggering or offset configuration is such that each hole such as hole 14*c* is staggered or offset relative to a diagonally adjacent hole 18*c*. Also, a row generally designated 100 of connectors 102, 103 and 104 is disposed parallel and spaced relative to the first row 26*c* and second row 30*c* of holes 14*c* to 17*c* and 18*c* to 21*c* respectively. The diagonal offset has greatly reduced a streaking effect in the resultant web thus resulting in a web having enhanced features when compared with webs formed on prior art arrangements.

Figure 7:
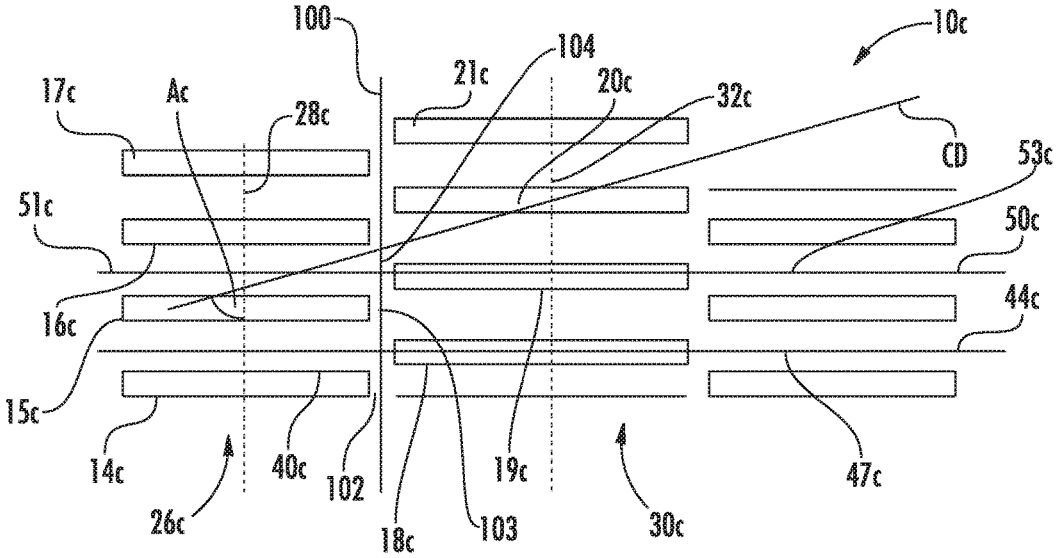
FIG. 7 is a top plan view of the cover device shown in FIG. 6.

FIG. 7 is a top plan view of the cover device 10*c* shown in FIG. 6. As shown in FIG. 7, the hole 14*c* is offset or staggered relative to the diagonally adjacent hole 18*c* of an adjacent row 30*c*.

In operation of the invention according to the present invention, the cover device 10 is fabricated from a sheet of expanded stainless steel and is coated with a layer of wear resistant ceramic material particularly on the side of the cover 10 coming into contact with the moving dewatering screen 24.

The present invention provides a unique cover device that has many advantages over the prior art arrangements and which greatly reduces the cost of manufacture of such cover device.

What is claimed is:

1. A cover device for a dewatering shoe of a papermaking machine, said cover device comprising:

a plate of expanded metal defining a plurality of elongate holes with an elongate cross-section for the passage therethrough of water removed from a web disposed on a dewatering screen moving relative to the cover device with the dewatering screen being disposed between the web and the plate of expanded metal so that the water is removed from the web through the dewatering screen and then through said elongate holes;

a first row of holes of said plurality of elongate holes, each hole of said first row having a first common longitudinal axis;

a second row of holes of said plurality of elongate holes, each hole of said second row having a second common longitudinal axis;

said first and second common longitudinal axes being disposed spaced and parallel relative to each other;

said plate of expanded metal including:

a metal bridge disposed between each hole of said first row of holes and an adjacent hole of said first row of holes;

a metal connector is disposed between each hole of said first row of holes and an adjacent hole of said second row of holes;

said bridge being disposed at a first distance relative to the dewatering screen moving relative to the cover device;

said connector disposed adjacent to said bridge being disposed at a second distance relative to the dewatering screen moving relative to the cover device; and said second distance being greater than said first distance so that the dewatering screen slides over and is supported by said bridges during movement of the dewatering screen while moving relative to the cover device.

2. A cover device as set forth in claim 1 wherein said plate has a leading edge and a trailing edge, said leading edge and said trailing edge being disposed parallel and spaced relative to each other.

3. A cover device as set forth in claim 2 wherein said leading edge and said trailing edge are disposed parallel relative to a cross machine direction of the dewatering screen when moving relative to the cover device.

4. A cover device as set forth in claim 3 wherein said common longitudinal axes of said rows of holes are disposed parallel relative to said cross machine direction.

5. A cover device as set forth in claim 3 wherein said common longitudinal axes of said rows of holes are disposed normal relative to said cross machine direction.

6. A cover device as set forth in claim 3 wherein said common longitudinal axes of said rows of holes are disposed at an angle within a range 35 to 55 degrees relative to said cross machine direction.

7. A cover device as set forth in claim 1 wherein a metal bridge is disposed between each hole of said first row of holes and an adjacent hole of said first row of holes.

8. A cover device as set forth in claim 1 wherein a metal connector is disposed between each hole of said first row and an adjacent hole of said second row.

9. A cover device as set forth in claim 1 wherein a first column of bridges being disposed parallel and spaced relative to a second column of bridges; and a column of connectors being disposed parallel and spaced relative to said first and second column of bridges, said column of connectors being disposed between said first column of bridges and said second column of bridges.

10. A cover device as set forth in claim 1 wherein said plate is fabricated from stainless steel.

11. A cover device as set forth in claim 1 wherein said plate is fabricated from stainless steel and coated with ceramic material.

12. A cover device for a dewatering shoe of a papermaking machine, said cover device comprising:

a plate of expanded metal defining a plurality of elongate holes with an elongate cross-section for the passage therethrough of water removed from a web disposed on a dewatering screen moving relative to the cover device with the dewatering screen being disposed between the web and the plate of expanded metal so that the water is removed from the web through the dewatering screen and then through said elongate holes;

a first row of holes of said plurality of elongate holes, each hole of said first row having a first common longitudinal axis;

a second row of holes of said plurality of elongate holes, each hole of said second row having a second common longitudinal axis;

said first and second common longitudinal axes being disposed spaced and parallel relative to each other;

said plate has a leading edge and a trailing edge, said leading edge and said trailing edge being disposed parallel and spaced relative to each other;

said leading edge and said trailing edge are disposed parallel relative to a cross machine direction of the dewatering screen when moving relative to the cover device;

said common longitudinal axes of said rows of holes are disposed at an angle within a range 35 to 95 degrees relative to said cross machine direction;

a metal bridge is disposed between each hole of said first row of holes and an adjacent hole of said first row of holes; a first column of bridges being disposed parallel and spaced relative to a second column of bridges;

a metal connector is disposed between each hole of said first row holes and an adjacent hole of said second row of holes;

a column of connectors being disposed parallel and spaced relative to said first and second column of bridges, said column of connectors being disposed between said first column of bridges and said second column of bridges;

each bridge is disposed at a first distance relative to the dewatering screen moving relative to the cover device;

each adjacent connector is disposed at a second distance relative to the dewatering screen moving relative to the cover device;

said second distance being greater than said first distance so that the dewatering screen slides over and is supported by said bridges during movement of the dewatering screen while moving relative to the cover device; and said plate is fabricated from stainless steel and coated with ceramic material.

* * * * *